US006343946B1

(12) United States Patent
Matsumoto

(10) Patent No.: US 6,343,946 B1
(45) Date of Patent: Feb. 5, 2002

(54) ROTARY CONNECTOR

(75) Inventor: Tsuyoshi Matsumoto, Tokyo (JP)

(73) Assignee: Niles Parts Co., Ltd (JP)

( * ) Notice: Subject to any disclaimer, the term of this patent is extended or adjusted under 35 U.S.C. 154(b) by 0 days.

(21) Appl. No.: 09/616,368

(22) Filed: Jul. 13, 2000

(30) Foreign Application Priority Data

Jul. 15, 1999 (JP) ..... 11-201144

(51) Int. Cl.[7] ..... H01R 3/00
(52) U.S. Cl. ..... 439/164
(58) Field of Search ..... 439/164, 15, 3, 439/885, 606, 169

(56) References Cited

U.S. PATENT DOCUMENTS 5,226,831 A * 7/1993 Hoiuchi ..... 439/164
5,645,441 A * 7/1997 Okuhara ..... 439/164
5,674,082 A * 10/1997 Okuhara et al. ..... 439/164
5,683,259 A * 11/1997 Sato ..... 439/164
5,772,456 A * 6/1998 Ohishi ..... 439/164
5,944,544 A * 8/1999 Kurada et al. ..... 439/164

FOREIGN PATENT DOCUMENTS

JP HEI1-161589 11/1989

* cited by examiner

*Primary Examiner*—Neil Abrams
*Assistant Examiner*—J. F. Duverne
(74) *Attorney, Agent, or Firm*—Ronald P. Kananen; Rader, Fishman & Grauer PLLC

(57) ABSTRACT

To provide a rotary connector of the construction in which the flat cable is not damaged when the user operates the steering wheel to which the rotary connector is normally assembled, and the flat cable is cut off when the user operates the steering wheel to which the rotary connector is incorrectly assembled, thus an accidental firing of the air bag is prevented. The rotary connector has a flat cable with one end connected to a terminal strap and the other end connected to a supporting member. The flat cable is in the shape of a spiral and is accommodated in a space G defined by a stator housing and a rotor housing, the rotor housing is rotatably assembled to the stator housing. The terminal strap is located between an inner wall of the stator housing and a guide disposed near the inner wall. The guide has a small-width strap with a curved surface in contact with the flat cable. The flat cable is routed through the gap between the inner wall of the stator housing and the small-width strap into a space G in the stator housing.

23 Claims, 5 Drawing Sheets

ROTARY CONNECTOR

BACKGROUND OF THE INVENTION

1. Field of the Invention

The present invention relates to a rotary connector for supplying electric power to an air bag or the like. More particularly, the present invention relates to a rotary connector used at a pad of a steering wheel of an automobile.

2. Description of the Related Art

A conventional rotary connector is commonly used for supplying electric power by incorporating a flat cable usually wound in a spiral fashion. Recently, a technique has been implemented in which when an accident occurs, an air bag pops out to protect the driver from the impact. This type of air bag, particularly the one provided at the pad of the steering wheel, requires electric power to be supplied from the vehicle side through a rotatable portion of the steering wheel to the inflater of the air bag system mounted on the pad side.

A variety of this type of rotary connectors have been proposed. For example, Japanese Utility Model Mo. 1-161589 discloses a rotary connector called a cable reel. This rotary connector includes a stator housing, a rotor housing rotatably assembled to the stator housing, and a flat cable accommodated in a spiral fashion in a space defined by the stator housing and the rotor housing. The rotary connector further includes a cutter and a cutting element provided at an end of the flat cable, the cutter and cutting element being used to cut the flat cable. Also a rotary connector can be assembled at a neutral position thereof from which the steering wheel can be rotated by two rotations leftward and rightward, respectively. If the rotary connector is assembled off the neutral position by steering wheel can be rotated by two rotations leftward and rightward, respectively, from the neutral position.

However, the aforementioned conventional rotary connector suffers from the problem that even if the rotary connector is assembled correctly to the steering wheel, the cutter and cutting member used for cutting the cable still remain in contact with the flat cable and therefore may damage the flat cable.

SUMMARY OF THE INVENTION

An object of the present invention is to provide a rotary connector in which the flat cable is not damaged when the rotary connector is assembled correctly and the flat cable can be cut off easily if the user operates a steering wheel to which a rotary connector is assembled incorrectly.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

According to a broad aspect of the present invention, the rotary connector having a flat cable with one end thereof connected to a terminal strap and the other end thereof connected to a supporting member, the flat cable being in the shape of a spiral and being accommodated in a space defined by a stator housing and a rotor housing rotatably assembled to the stator housing, characterized in that the terminal strap is located between an inner wall of the stator housing and a guide disposed near the inner wall. The guide has a small-width strap with a curved surface in contact with the flat cable; and the flat cable is routed to pass between the inner wall of the stator housing and the small-width strap into the space in the stator housing.

The stator housing has a projection formed on the inner wall near the small-width strap. The stator housing also has a projection formed on the inner wall between the terminal strap and the small-width strap. The guide has a recess near a location facing the projection. The projection has an inclined surface on a side thereof remote from the terminal strap.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A first embodiment of the present invention will now be described in detail with reference to FIGS. 1–5 of the accompanying drawings.

Figure 1:
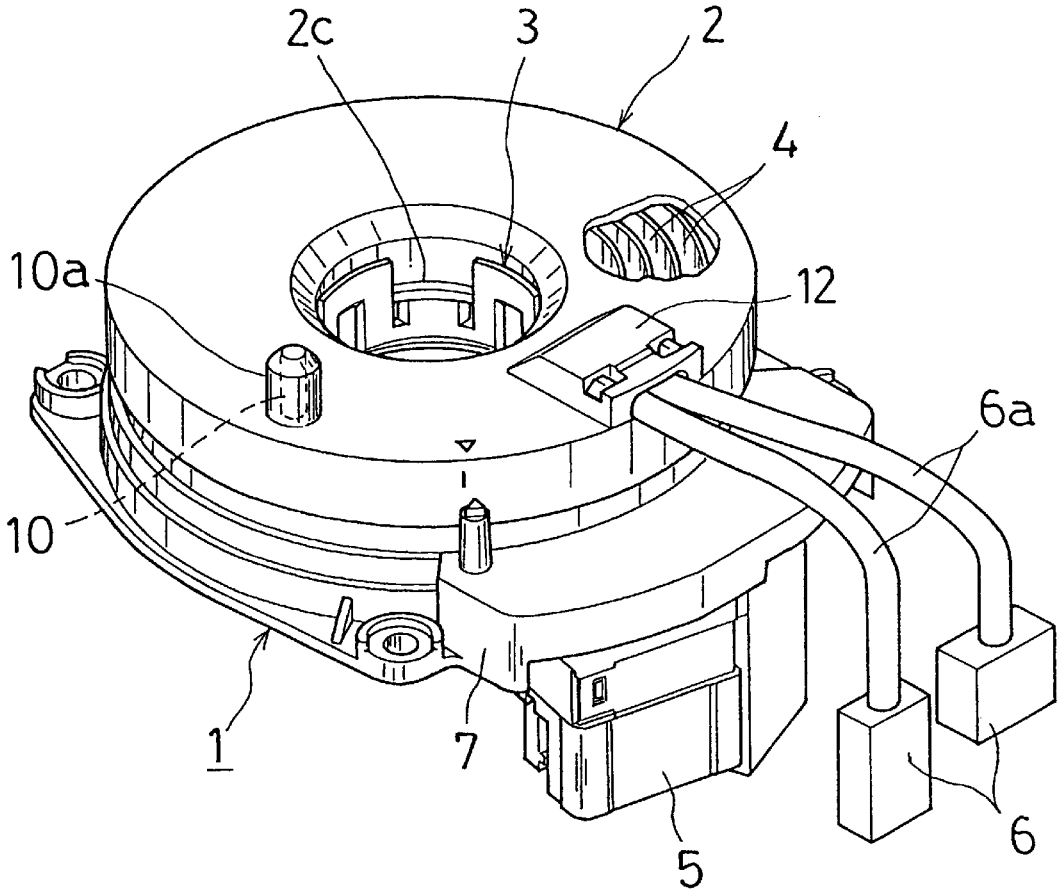
FIG. 1 is a perspective view of a rotary connector according to an embodiment of the present invention.

As shown in FIG. 1, a rotary connector includes the stator housing 1, rotor housing 2 rotatably assembled to the stator housing 1, and the flat cable 4 in the shape of a spiral. The flat cable 4 is housed in a space G (FIG. 3) defined by the stator housing 1 and the rotor housing 2.

Figure 2:
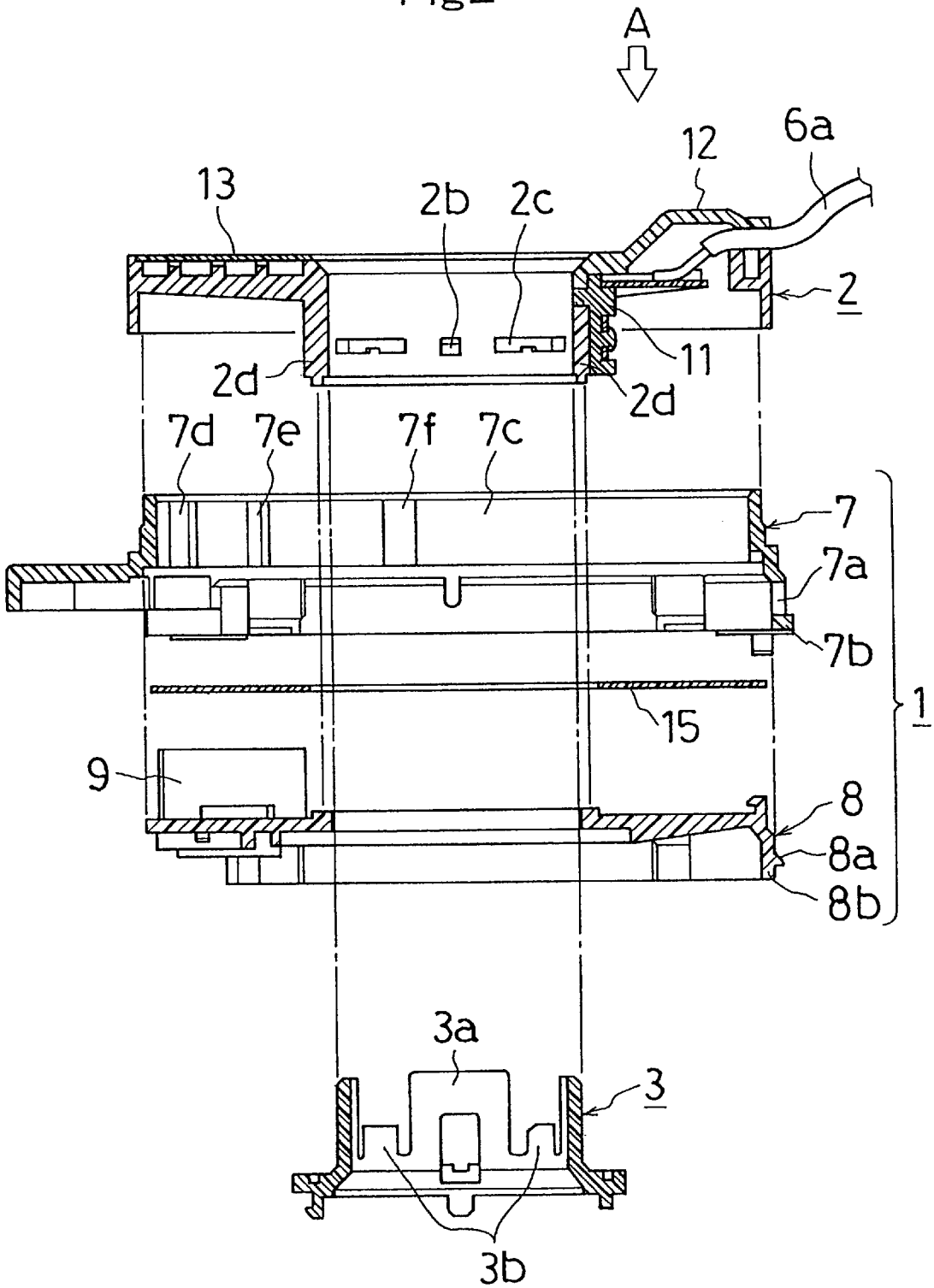
FIG. 2 is a cross-sectional view of the embodiment of a rotary connector according to an embodiment of the present invention taken along the diameter.

The stator housing 1 is a stationary component that is screwed down on the combination switch (not shown) of, for example, an automobile. The stator housing 1 includes a side housing 7 and a bottom housing 8 combined with the side housing 7. For more detail, the side housing 7 has a fitting hole 7*a* and the bottom housing has a fitting projection 8*a,* as shown in FIG. 2. The fitting projection 8*a* is fitted into the fitting hole 7*a,* thereby assembling the bottom housing 8 to the side housing 7. The side housing 7 and bottom housing 8 may be formed in one piece, thereby providing a single piece stator housing 1.

The side housing 7 and the bottom housing 8 have base portions 7*b* and 8*b,* respectively, that are flush with each other when they are assembled together. Thus, when the stator housing 1 has been fixed to the combination switch, both the base portions 7*b* and 8*b* abut the combination switch. Therefore, if an external force is exerted on the bottom housing 8 in a direction shown by arrow A of FIG. 2, the base portion 8*b* abuts the combination switch, so that the bottom housing 8 is prevented from being deformed in the direction shown by the arrow A as well as the fitting projection 8*a* of the bottom housing 8 is prevented from dropping out of the fitting hole 7*a* of the side housing 7.

As shown in FIG. 2, the bottom housing 8 has a guide 9 that holds an end of the flat cable 4 and guides the flat cable 4 in a space G defined by the stator housing 1 and the rotor housing 2. There is provided a slide sheet 15 on top of the bottom housing 8.

The rotor housing 2 is rotatably fitted into the stator housing 1 and is coupled to the steering wheel (not shown) by means of a coupling pin 10 having a resilient cover 10*a* fitted thereover. The rotor housing 2 has projections 2*b* and a stepped portion 2*c* on its inner circumferential surface 2*a*. The projections 2*b* fit into fitting portions 3*a* formed on an attachment 3. The stepped portions 2*c* abut projecting straps 3*b* formed on the attachment 3.

The rotor housing 2 has a cord cover 12 that covers cords 6*a* of connectors 6 led out of the rotor housing 2 and secures a later-described supporting member 11 to the rotor housing 2. The cord cover 12 is inserted into the top surface of the rotor housing 2 and is fixed by heat bonding or ultrasonic bonding. The rotor housing 2 has a caution label 13 stuck on the top surface of the rotor housing 2 as shown in FIG. 2. The caution label 13 lists cautions about the handling of the rotary connector.

The supporting member 11 is a component that supports one end of the flat cable 4 as shown in FIG. 2. The supporting member 11 is also a member that prevents the flat cable 4 from buckling, thereby protecting the flat cable 4 from breakage and damage. The attachment 3 is a member that couples the stator housing 1 to the rotor housing 2. The attachment 3 has the fitting portions 3*a* and projecting straps 3*b*. The fitting portions 3*a* resiliently engage the projections 2*b* of the rotor housing 2, and the projecting straps 3*b* abut the stepped portions 2*c* of the rotor housing 2. The attachment 3 slides on the inner surface of the bottom housing 8, serving as a radial (direction of radius) bearing.

Figure 4:
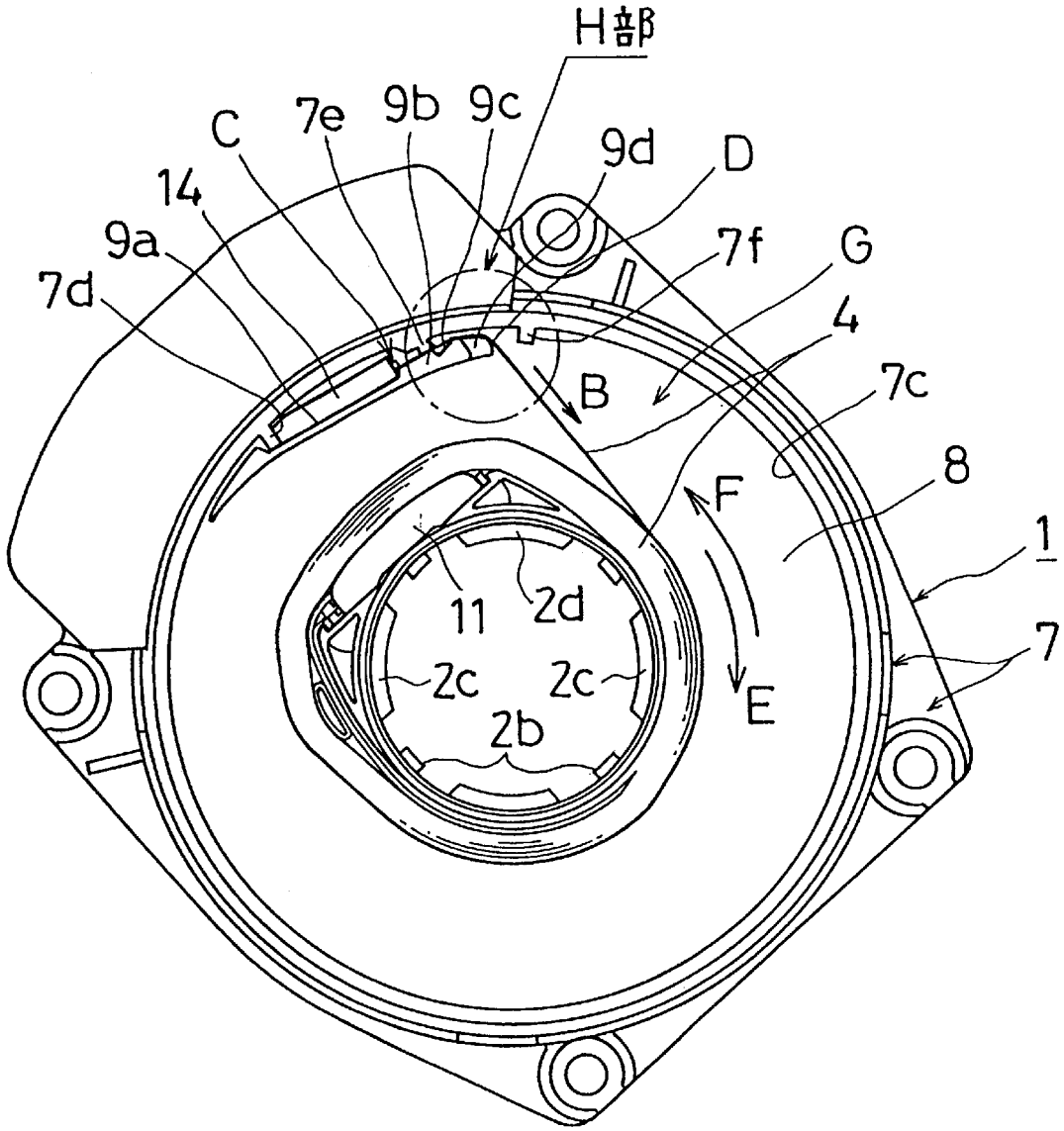
FIG. 4 is a top plan view of the stator housing having the flat cable according to an embodiment of the present invention.

As shown in FIG. 4, the flat cable 4 includes a plurality of conductive wires 4*a* and sheets of resin film 4*b* between which the plurality of conductive wires 4*a* are sandwiched. The plurality of conductive belt-shaped wires 4*a* are arranged at predetermined intervals and are sandwiched between two sheets of insulating resin film 4*b*. The flat cable 4 has one end fixed to a terminal strap 14 that is electrically connected to a connector 5 and the other end fixed to the supporting member 11 mounted to the rotor housing 2.

The conductive wires 4*a* have front and back surfaces bonded to two sheets of resin film 4*b*. The conductive wires 4*a* are flat belt-shaped and have one ends thereof connected to the air bag apparatus accommodated in the steering wheel and the other ends thereof electrically connected to a power supply and sensors of the air bag apparatus. The conductive wires 4*a* include a total of three wires; two wires for the air bag and one wire for a horn. The number of conductive wires is not limited to three and may be selected in accordance with the design purpose.

The resin film 4*b* is of the construction in which two laminated films for example, polyethylene terephthalate are contact bonded by heat or bonded by an adhesive such that the plurality of conductive wires 4*a* are insulated from each other.

The flat cable 4 is housed in a doughnut-shaped space G defined by the stator housing 1 and the rotor housing 2. The flat cable 4 is rotatable leftward and rightward, at least two complete rotations in each direction. One end of the flat cable 4 is electrically connected to the connector 5 of the stator housing 1 via the terminal strap 14 and the other end of the flat cable 4 is connected to the connectors 6 of the rotor housing 2 via the supporting member 11.

Figure 3:
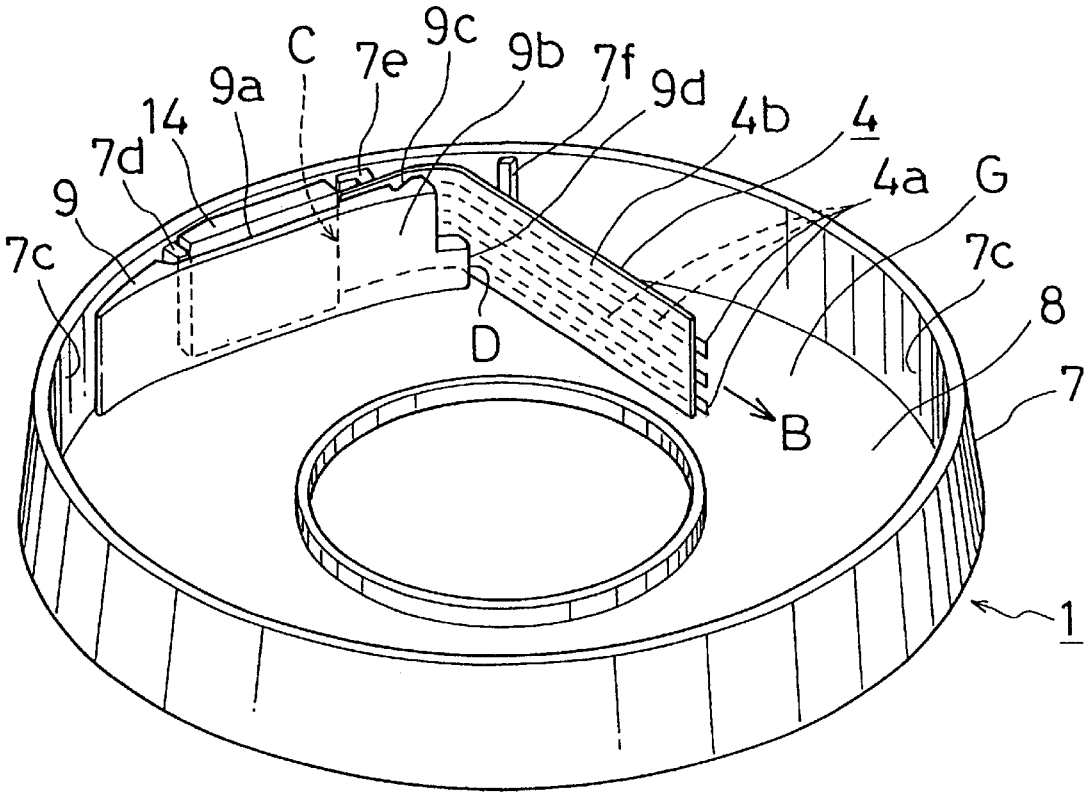
FIG. 3 is an enlarged perspective view of a stator housing having a flat cable according to an embodiment of the present invention.

As shown in FIGS. 2 and 4, the supporting member 11 connected to the flat cable 4 is fastened to the outer wall of a hollow shaft 2*d* of the rotor housing 2. As shown in FIGS. 3 and 4, the terminal strap 14 located at the other end of the flat cable 4 is disposed between an inner wall 7*c* of the side housing 7 and the guide 9 near the upper outer periphery of the bottom housing 8.

The terminal strap 14 is an resin material in which conductors (not shown) are insert molded. The conductors have lateral ends connected to the respective conductive wires 4*a* and downward ends connected to the respective ends of the terminals (not shown) of the connector 5. The terminal strap 14 is mounted to the bottom surface of the bottom housing 8. As shown in FIGS. 3 and 4, the terminal strap 14 engages a bottom surface 9*a* of a recess formed in the guide 9 and is received between projections 7*d* and 7*e* formed on the inner wall 7*c* of the side housing 7.

The projections 7*d*, 7*e*, and 7*f* are vertically extending on the inner wall 7*c* of the side housing 7. As shown In FIGS. 3 and 4, the projection 7*d* cooperates with the bottom surface 9*a* of the guide 9 to support the terminal strap 14 therebetween.

Figure 5:
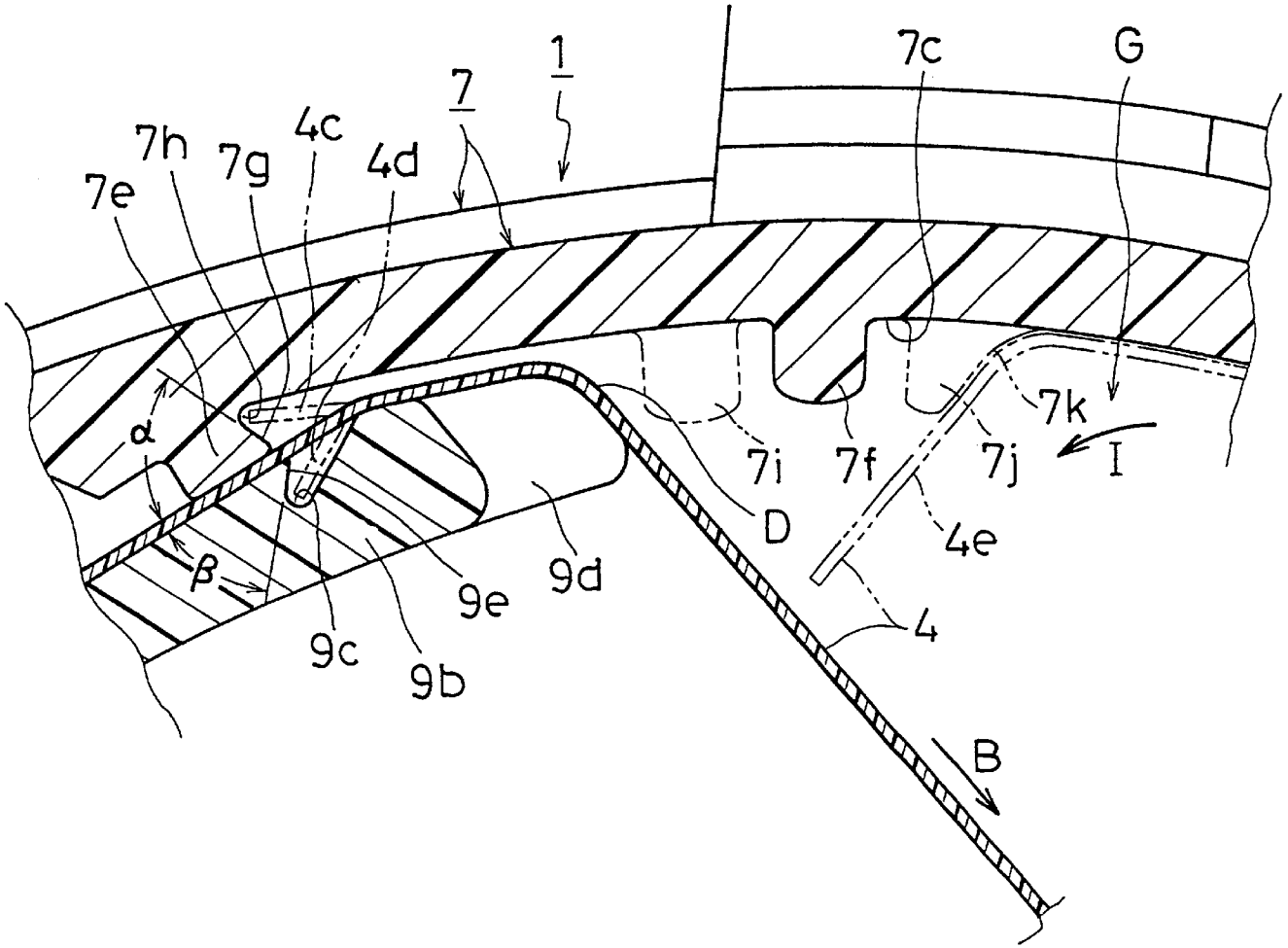
FIG. 5 is an enlarged view of a part depicted at H of FIG. 4.

As shown in FIGS. 3, 4, and 5, a projection 7*e* opposes a guide strap 9*b* of the guide 9 and is aligned with an edge of a recess 9*c* formed in a surface of the guide strap 9*b* facing the inner wall 7*c*. The projection 7*e* cooperates with the guide strap 9*b* to support the end of the flat cable 4, and cooperates with the recess 9*c* to prevent the cut end of the flat cable 4 from again entering a gap between the guide 9 and the inner wall 7*c* after the flat cable 4 has been out off at the connection C connected to the terminal strap 14. In this manner, the construction prevents the cut end of the flat cable 4 from short-circuiting.

The projection 7*e* has a side surface 7*g* closer to the small-width strap 9*d*. The side surface 7*g* is inclined to make an acute angle a with the flat cable 4. As shown in FIG. 5, when a flat cable 4*c* that has been cut off enters a space between the inner wall 7*c* and the guide strap 9*b*, the cut end of the flat cable 4*c* strikes the side surface 7*g* and slips to a base portion 7*h* of the projection 7*e* where the tip of the flat cable 4*c* is finally stopped. In this manner, the flat cable 4*c* is prevented from entering the gap between the guide 9 and the inner wall 7*c*.

As shown in FIG. 5, a projection 7*f* prevents a flat cable 4*e* from again entering the gap between the guide 9 and inner wall 7*c* after the flat cable 4 has been cut off, ensuring that the flat cable 4*e* will not be short-circuited to inadvertently fire the air bag. The projection 7*f* should be provided at a location near the small-width strap 9*d*, including a location 7*i* shown by a phantom line adjacent to the small-width strap 9*d* and a location 7*j* further away from the small-width strap 9*d* as shown in FIG. 5.

The projections 7*f*, 7*i*, and 7*j* may have inclined side surfaces such as a surface 7*k* formed on the projection 7*j* shown by phantom lines in FIG. 5. The surface 7*k* guides the flat cable 4*e*, which moves toward the guide 9 in a direction shown by arrow I, toward the center of the rotary connector. The side surface 7*k* is formed on a side of the projections 7*f*, 7*i*, and 7*i* remote from the guide 9. The side surface 7*k* may be a flat surface or a curved surface.

The guide 9 is a projected strap provided at a location over the connector 5 of the bottom housing 8. The guide 9 includes guide strap 9*b*, recess 9*c*, small-width strap 9*d*, and the recess having the bottom surface 9*a*. The guide 9 extends along the inner wall 7*c* of the side housing 7, generally describing an arc.

The bottom surface 9*a* of the recess is a bottom surface of a groove with which the projection 7*d* and the terminal strap 14 are engaged. When the user rotates the steering wheel, the guide strap 9*b* guides the flat cable 4 in such a way that the flat cable 4 connected to the terminal strap 14 expands or contracts within the side housing 7 while maintaining its spiral shape.

Just like the projections 7*e* and 7*f*, when the flat cable 4 has been cut off at the connection C connected to the terminal strap 14, the recess 9*c* serves to prevent the reentering of the flat cable 4 between the inner wall 7*c* and the guide 9 which would otherwise cause a short-circuit. The recess 9*c* is a substantially U-shaped groove having a side wall 9*e*. The side wall 9*e* is closer to the terminal strap 14 and is aligned with the tip of the side surface 7*g* of the projection 7*e*.

The side wall 9*e* is inclined such that the side wall 9*e* makes an acute angle β with the flat cable 4. When a flat cable 4*d* again enters the gap between the inner wall 7*c* and the guide strap 9*b*, as shown in FIG. 5, after the flat cable 4 has been cut the tip of the flat cable 4*d* strikes the side wall 9*e* and slides on the side wall 9*e* toward a recess 9*c*. The tip of the cable 4*d* is stopped at the recess 9*c*. Thus, the flat cable 4*d* is prevented from entering the gap between the guide 9 and the inner wall 7*c*.

The small-width strap 9*d* is a projecting strap formed at the lower end of the guide strap 9*b* and is in contact with the flat cable 4. The small-width strap 9*d* has a shorter vertical width than the guide strap 9*b*. When the user operates the steering wheel to which the rotary connector is incorrectly assembled, the small-width strap 9*d* exerts a concentrated stress on the flat cable 4 that is in contact with the small-width strap 9*d*, thereby cutting off the flat cable 4 at the connection C connected to the terminal strap 14. The small-width strap 9d has a rounded tip portion such that the friction resistance between the flat cable 4 and the small-width strap 9*d* is small when the rotary connector is assembled correctly. The small-width strap 9*d* may be at a vertically upper end or middle of the guide strap 9*b*, provided that the small-width strap 9*d* is at the tip of the guide strap 9*b*. The small-width strap 9*d* should be located where the small-width strap 9*d* presses the conductive wires 4*a* hard, so that the flat cable 4 can be cut off efficiently at the connection C connected to the terminal strap 14.

In operation, the rotary connector having the flat cable 4 has the connectors 6 connected to, for example, an air bag apparatus (not shown) on the steering wheel side and the other connector 5 to, for example, air bag controller (not shown) on the vehicle side. Thus, in the event of crash of the vehicle, the electrical signal generated by the air bag controller is sent to the air bag apparatus provided at the steering pa via the flat cable 4 of the rotary connector, thereby firing the inflater to inflate the air bag.

When the user operates the steering wheel, the steering wheel rotates together with the rotor housing 2 and attachment 3, so that the flat cable 4 slides. When the rotary connector is correctly mounted to the steering wheel, the steering wheel and flat cable 4 rotate leftward and rightward from the position at which the vehicle run straightly, rotating through two complete rotations in each direction. No load is exerted on the contact portion D between the flat cable 4 and the small-width strap 9*d* of the guide 9. Additionally, the flat cable 4 is not damaged because the small-width strap 9*d* has a curved surface. For example, FIG. 4 illustrates the rotary connector when the user operates the steering wheel rightward in the direction shown by arrow E more than one rotation, if the rotary connector has been inadvertently assembled with the steering wheel rotated rightward by one complete rotation from the neutral position. Rotating the steering wheel causes the flat cable 4 to be taut. The flat cable 4 near the guide 9 is pulled in the direction shown by arrow B as shown in FIGS. 3 and 4, so that a stress is concentrated on the contact portion D at which the flat cable 4 is in contact with the small-width strap 9*d*. The small-width strap 9*d* has a shorter vertical dimension than the guide 9, so that the stress exerted on the flat cable 4 at the contact portion D is large.

When the user operates the steering wheel further in the direction shown by arrow E, for example, to make a right turn, the flat cable 4 is cut off at the weakest portion, i.e., the connection portion C connected to the terminal strap 14. Since the flat cable 4 is cut off, the steering wheel can be operated in the same manner that the rotary connector is assembled correctly When the steering wheel has been rotated more than one complete rotation rightward in the direction shown by arrow E after the flat cable 4 has been cut off, the cut end of the connection portion C is pulled in the direction shown by arrow B, passing between the guide 9 and the inner wall 7*c* to the space G in the side housing 7.

When the user rotates the steering wheel in a direction shown by arrow F shown in FIG. 4, the cut end of the connection portion C of the flat cable 4 also moves in the direction shown by arrow F. The cut end of the connection portion C of the flat cable 4 strikes the projection 7*f*, which prevents the flat cable 4 from entering the gap between the guide 9 and the inner wall 7*c*. Thus, even if the cut end of the connection portion C passes between the small width strap 9*d* and the inner wall 7*c* into the space between the side wall 9*e* and the inner wall 7*c*, the projection 7*e* cooperates with the recess 9*c* to prevent the cut end of the connection portion C from entering further through the gap to a position where the cut end of the connection portion C may reach the terminal strap 14.

Thus, the construction prevents the short circuit of the conductive wires 4*a* of the flat cable 4 to the terminals of the terminal strap 14, which would otherwise cause the air bag system to go off spontaneously. The present invention of the aforementioned construction It will be appreciated that the present invention is not limited to the exact construction that has been described above and illustrated in the accompanying drawings, and that various modifications and changes can be made without departing from the scope and spirit thereof It is intended that the scope of the invention only be limited by the appended claims.

What is claimed is:

1. A rotary connector having a flat cable with one end connected to a terminal strap located between an inner wall of a stator housing and another end connected to a supporting member, the flat cable being in the shape of a spiral accommodated in a space defined by the stator housing and a rotor housing assembled to the stator housing, said rotary connector comprising:

a guide disposed near the inner wall, the guide having a small-width strap with a curved surface in contact with the flat cable, the flat cable being routed to pass through a gap between the inner wall of the stator housing and the small-width strap into the space in the stator housing, said small-width strap being positioned at a distal end of said guide.

2. The rotary connector according to claim 1, wherein the stator housing has a projection formed on the inner wall between the terminal strap and the small-width strap.

3. The rotary connector according to claim 2, wherein the projection is aligned with an edge of a recess in the guide facing the inner wall.

4. The rotary connector according to claim 3, wherein the projection has an inclined side surface closer to the small-width strap.

5. The rotary connector according to claim 3, wherein the projection cooperates with the guide strap to support an end of the flat cable and cooperates with the recess to prevent a cut end of the flat cable from again entering a gap between the guide and the inner wall after the flat cable has been cut off at a connection connected to the terminal strap.

6. The rotary connector according to claim 1, wherein the flat cable has the one end fixed to the terminal strap that is electrically connected to a connector.

7. The rotary connector according to claim 1, wherein the stator housing has a projection formed on the inner wall near the strip-width strap.

8. The rotary connector according to claim 7, wherein the projection has a inclined surface on a side thereof remote from the terminal strap, the inclined surface guides the flat cable, which moved towards the guide, toward a center of the rotary connector.

9. A rotary connector comprising:

a flat cable having an end connected to a terminal strap being located between an inner wall electrically connected to a connector and an opposite end connected to a supporting member that is mounted to a rotary housing;

a space for housing the flat cable and being defined by a stator housing and the rotary housing, the rotary housing being attached to said stator housing;

a projection formed on the inner wall between the terminal strap and a small-width strap and having an inclined surface on a side thereof closer to the small-width strap; and a guide disposed near an inner wall having the small width strap with a curved surface in contact with said flat strap, the guide has a recess near a location facing the projection, said small-width strap being positioned at a distal end portion of said guide.

10. The rotary connector according to claim 9, wherein said projection cooperates with the recess to prevent a cut end of the flat cable from again entering a gap between said guide and said inner wall after said cable has been cut at a connection connected to the terminal strap.

11. A rotary connector comprising:

a flat cable having an end connected to a terminal strap being located between an inner wall electrically connected to a connector and an opposite end connected to a supporting member that is mounted to a rotary housing;

a space for housing the flat cable and being defined by a stator housing and the rotary housing, the rotary housing being attached to said stator housing;

a projection formed near a small-width strap and having an inclined surface on a side thereof remote from the terminal strap; and a guide disposed near an inner wall having the small width strap with a curved surface in contact with said flat strap, the guide has a recess near a location facing the projection, said small-width strap being positioned at a distal end portion of said guide.

12. The rotary connector according to claim 11, wherin the projection has a inclined surface on a side thereof remote from the terminal strap, the inclined surface guides the flat cable, which moved towards the guide, toward a center of the rotary connector.

13. The rotary connector according to claim 11, wherein the stator housing has a second projection formed on the inner wall between the terminal strap and the small-width strap.

14. A rotary connector having a flat cable with one end connected to a terminal strap located between an inner wall of a stator housing and another end connected to a supporting member, the flat cable being in the shape of a spiral accommodated in a space defined by the stator housing and a rotor housing rotatably assembled to the stator housing, said rotary connector comprising:

a guide disposed near the inner wall, the guide having a small-width strap with a curved surface in contact with the flat cable, the flat cable being routed to pass through a gap between the inner wall of the stator housing and the small-width strap into the space in the stator housing.

15. The rotary connector according to claim 14, wherein the cut end of the flat cable strikes the inclined side surface after entering the space between the inner wall and the guide causing the cut end of the flat cable to slip to a base portion of the projection stopping the flat cable.

16. The rotary connector according to claim 14, wherein when the flat cable again enters the gap between the inner wall and the guide strap, after the cable has been cut, a tip of the flat cable strikes a side wall and slides toward the recess thus stopping the flat cable.

17. A rotary connector having a flat cable with one end connected to a terminal strap located between an inner wall of a stator housing and another end connected to a supporting member, the flat cable being in the shape of a spiral accommodated in a space defined by the stator housing and a rotor housing rotatably assembled to the stator housing, said rotary connector comprising:

a guide disposed near the inner wall, the guide having a small-width strap with a curved surface in contact with the flat cable, the flat cable being routed to pass through a gap between the inner wall of the stator housing and the small-width strap into the space in the stator housing;

wherein the projection is aligned with an edge of a recess in the guide facing the inner wall;

wherein the projection cooperates with the guide strap to support an end of the flat cable and cooperates with the recess to prevent a cut end of the flat cable from again entering a gap between the guide and the inner wall after the flat cable has been cut off at a connection to the terminal strap;

wherein the flat cable has the one end fixed to the terminal strap that is electrically connected to a connector.

18. The rotary connector according to claim 17, wherein the flat cable has the other end connected to the supporting member that is mounted to the rotary housing.

19. A rotary connector having a flat cable with one end connected to a terminal strap located between an inner wall of a stator housing and other end connected to a supporting member, the flat cable being in the shape of a spiral accommodated in a space defined by the stator housing and a rotor housing rotatably assembled to the stator housing, said rotary connector comprising:

a guide disposed near the inner wall, the guide having a small-width strap with a curved surface in contact with the flat cable, the flat cable being routed to pass through a gap between the inner wall of the stator housing and the small-width strap into the space in the stator housing;

wherein the stator housing has a projection formed on the inner wall near the small-width strap;

wherein the projection has a inclined surface on a side thereof remote from the terminal strap, the inclined surface guides the flat cable, which moved towards the guide, toward a center of the rotary connector.

20. The rotary connector according to claim 19, wherein the projection prevents the flat cable from again entering a gap between the guide and the inner wall after the flat cable has been cut off at a connection connected to the terminal strap.

21. A rotary connector comprising:

a flat cable having an end connected to a terminal strap being located between an inner wall electrically connected to a connector and an opposite end connected to a supporting member that is mounted to a rotary housing;

a space for housing the flat cable and being defined by a stator housing and the rotary housing, the rotary housing is rotatably attached to said stator housing;

a projection formed on the inner wall between the terminal strap and a small-width strap and having an inclined surface on a side thereof closer to the small-width strap; and a guide disposed near an inner wall having the small width strap with a curved surface in contact with said flat strap, the guide having a recess near a location facing the projection;

wherein said projection cooperates with the recess to prevent a cut end of the flat cable from again entering a gap between said guide and said inner wall after said cable has been cut a connection connected to the terminal strap.

22. The rotary connector according to claim 21, wherein when the flat cable enters the gap between the inner wall and the guide strap, after the cable has been cut, a tip of the flat cable strikes a side wall and slides toward the recess thus stopping the flat cable.

23. The rotary connector according to claim 21, wherein the stator housing has a second projection formed on the inner wall near the small-width strap.

* * * * *

UNITED STATES PATENT AND TRADEMARK OFFICE

CERTIFICATE OF CORRECTION

PATENT NO. : 6,343,946 B1
DATED : February 5, 2002
INVENTOR(S) : Tsuyoshi Matsumoto It is certified that error appears in the above-identified patent and that said Letters Patent is hereby corrected as shown below:

Column 7,
Line 17, replace “a” with -- an --.
Line 61, replace “wherin” with -- wherein --.
Line 62, replace “a” with -- an --.

Column 8,
Line 43, insert between “connection” and “to” the word -- connected --.
Line 52, replace “other” with -- another --.
Line 65, replace “a” with -- an --.

Column 10,
Line 8, replace “cut a” with -- cut at a --.
Line 11, insert between “cable” and “enters” the word -- again --.

Signed and Sealed this

Twenty-fifth Day of March, 2003

JAMES E. ROGAN
*Director of the United States Patent and Trademark Office*